US010804590B2

(12) United States Patent
Tonoe et al.

(10) Patent No.: US 10,804,590 B2
(45) Date of Patent: Oct. 13, 2020

(54) ANTENNA AND WINDOW GLASS

(71) Applicant: CENTRAL GLASS COMPANY, LIMITED, Ube-shi, Yamaguchi (JP)

(72) Inventors: Kazuhito Tonoe, Matsusaka (JP); Kanya Hirabayashi, Matsusaka (JP)

(73) Assignee: CENTRAL GLASS COMPANY, LIMITED, Yamaguchi (JP)

( * ) Notice: Subject to any disclaimer, the term of this patent is extended or adjusted under 35 U.S.C. 154(b) by 0 days.

(21) Appl. No.: 16/470,377

(22) PCT Filed: Feb. 27, 2018

(86) PCT No.: PCT/JP2018/007176
§ 371 (c)(1),
(2) Date: Jun. 17, 2019

(87) PCT Pub. No.: WO2018/190011
PCT Pub. Date: Oct. 18, 2018

(65) Prior Publication Data

US 2019/0312341 A1 Oct. 10, 2019

(30) Foreign Application Priority Data

Apr. 12, 2017 (JP) ..... 2017-079075

(51) Int. Cl.
*H01Q 1/12* (2006.01)
*H01Q 21/30* (2006.01)

(52) U.S. Cl.
CPC ..... *H01Q 1/1271* (2013.01); *H01Q 21/30* (2013.01)

(58) Field of Classification Search
CPC ..... H01Q 1/32; H01Q 1/325; H01Q 1/1271
See application file for complete search history.

(56) References Cited

U.S. PATENT DOCUMENTS

2016/0294037 A1 10/2016 Ochi et al.

FOREIGN PATENT DOCUMENTS

| | | |
|---|---|---|
| JP | 8-139513 A | 5/1996 |
| JP | 9-18221 A | 1/1997 |
| JP | 11-205022 A | 7/1999 |

(Continued)

OTHER PUBLICATIONS

International Search Report dated May 22, 2018, issued in counterpart International Application No. PCT/JP2018/007176, with English Transalation (5 pages).

*Primary Examiner* — Robert Karacsony
(74) *Attorney, Agent, or Firm* — Westerman, Hattori, Daniels & Adrian, LLP

(57) ABSTRACT

To provide excellent reception performance on a narrow area of an automotive window glass, it is provided an antenna to be arranged on a window glass of a vehicle, the antenna comprising: a core-side power feeding unit; an earth-side power feeding unit; a first element extending from the core-side power feeding unit; and a second element extending at an angle of approximately 90 degrees with respect to the first element from the core-side power feeding unit, the first element having a length of $3\alpha\lambda/4+\delta$ and the second element having a length of $\alpha\lambda/4-\delta$, or the first element having a length of $3\alpha\lambda/4-\delta$ and the second element having a length of $\alpha\lambda/4+\delta$, where $\lambda$ refers to a wavelength of a reception frequency, $\alpha$ refers to a wavelength shortening rate of glass, and $\delta$ refers to an offset length for each of the first element and the second elements.

6 Claims, 5 Drawing Sheets

(56) References Cited

FOREIGN PATENT DOCUMENTS

| | | | |
|---|---|---|---|
| JP | 2009-33687 | A | 2/2009 |
| JP | 2009-253947 | A | 10/2009 |
| JP | 2011-147102 | A | 7/2011 |
| JP | 2013-26828 | A | 2/2013 |
| JP | 2013-198090 | A | 9/2013 |
| JP | 2016-58946 | A | 4/2016 |
| JP | 2016-195299 | A | 11/2016 |

ANTENNA AND WINDOW GLASS

BACKGROUND OF THE INVENTION

This invention relates to a glass antenna to be arranged on a surface of a glass plate, and more particularly, to an antenna for receiving satellite waves.

An antenna for receiving satellite waves may be disposed on a window glass of a vehicle. As such an antenna for receiving satellite waves, in JP 2011-147102 A, a circular polarized antenna is described. The circular polarized antenna, which is a glass antenna, includes a core-side element coupled to a core-side power feeding point, and a ground-side element including a ground-side power feeding point therein. The ground-side element includes a ground planar conductor portion having a substantially rectangular shape at a position close to the core-side power feeding point, and at least one ground-side power feeding point is provided in the plane of the ground planar conductor portion. The core-side element includes at least one of an orthogonal line, which is orthogonal to an imaginary line provided to be perpendicular to a side of the ground planar conductor portion facing the core-side power feeding point and which extends in a direction separated from the ground planar conductor portion, or a parallel line extending substantially in parallel to the imaginary line and in a direction separated from the ground planar conductor portion.

Meanwhile, in JP 2013-26828 A, there is described a vehicle circular polarized antenna in which a positive-electrode-side element and a negative-electrode-side element are disposed on the same plane. The positive-electrode-side element includes at least a positive-electrode-side power feeding point, a positive-electrode-side planar body, on which the positive-electrode-side power feeding point is placed, and a positive-electrode-side main line coupled to the positive-electrode-side planar body. The negative-electrode-side element includes at least a negative-electrode-side power feeding point, a negative-electrode-side planar body, on which the negative-electrode-side power feeding point is placed, and a negative-electrode-side main line coupled to the negative-electrode-side planar body. A leading end portion of the positive-electrode-side main line and a leading end portion of the negative-electrode-side main line overlap each other to be capacitively coupled to each other.

An antenna for receiving satellite waves is often provided on a front window glass so as to easily capture radio waves arriving from above. In this case, it is difficult to dispose a large distinct pattern on a glass plate without interfering with a driver's field of view.

It is therefore an object to provide an antenna capable pf providing excellent reception performance even when the antenna is disposed on a narrow area of an automotive window glass.

SUMMARY OF THE INVENTION

That is, according to at least one embodiment of this invention, there is provided an antenna to be arranged on a window glass of a vehicle, the antenna comprising: a core-side power feeding unit; an earth-side power feeding unit; a first element extending from the core-side power feeding unit; and a second element extending at an angle of approximately 90 degrees with respect to the first element from the core-side power feeding unit, the first element having a length of $3\alpha\lambda/4+\delta$ and the second element having a length of $\alpha\lambda/4-\delta$, or the first element having a length of $3\alpha\lambda/4-\delta$ and the second element having a length of $\alpha\lambda/4+\delta$, where $\lambda$ refers to a wavelength of a reception frequency, $\alpha$ refers to a wavelength shortening rate of glass, and $\delta$ refers to an offset length for each of the first element and the second elements.

Further, in the glass antenna according to the one embodiment of this invention, the core-side power feeding unit and the earth-side power feeding unit are arranged along a body flange of the vehicle, and each of the first element and the second element extends from the core-side power feeding unit in a direction separated from the body flange.

Further, in the glass antenna according to the one embodiment of this invention, the first element is formed on the window glass to have a shape by bending back the first element at least once, and the antenna further comprises a bridge line configured to short-circuit portions of the first element before and after a bent back portion of the first element.

Further, the glass antenna according to the one embodiment of this invention comprising a parasitic element including a line having three sides surrounding the first element, the second element, the core-side power feeding unit, and the earth-side power feeding unit, and on an opening side of the parasitic element, the earth-side power feeding unit is disposed along a body flange of the vehicle.

Further, in the glass antenna according to the one embodiment of this invention, the parasitic element includes a side line, which is provided on a lateral side of each of the first element and the second element, an upper line which is provided over the first element and has one end coupled to the side line, and a lower line, which is provided under the second element and has one end coupled to the side line, and another end portion of the upper line and another end portion of the lower line form an opening, and the opening have a size larger than a length of the side line.

Further, a window glass according to the one embodiment of this invention comprising any one of the antennas being arranged on the window glass.

According to the representative embodiment of this invention, it is possible to equalize the directivity of the antenna in a front-rear direction and in a left-right direction and thus improve receiving sensitivity to a circularly polarized wave. Accordingly, the antenna is suitable for reception of a GPS signal made of a circularly polarized wave at a specified frequency in a 1 to 2 gigahertz band.

BRIEF DESCRIPTION OF THE DRAWINGS

The present invention can be appreciated by the description which follows in conjunction with the following figures, wherein.

DETAILED DESCRIPTION OF THE PREFERRED EMBODIMENT

Figure 1:
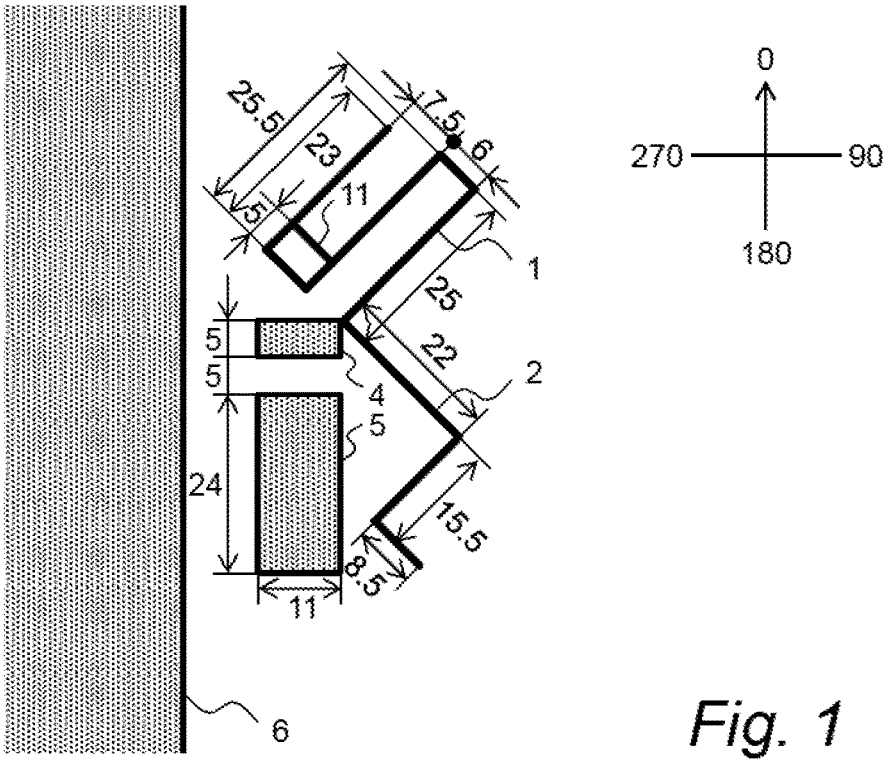
FIG. 1 is a plan view of a glass antenna (having a basic configuration) according to a first embodiment of this invention as viewed from a vehicle interior side.

FIG. 1 is a plan view of a glass antenna according to a first embodiment of this invention as viewed from a vehicle interior side.

The glass antenna having a basic configuration illustrated in FIG. 1 includes a first element 1 and a second element 2 each extending from a core-side power feeding unit 4. In the vicinity of the core-side power feeding unit 4, an earth-side power feeding unit 5 is provided. The core-side power feeding unit 4 and the earth-side power feeding unit 5 are arranged along a body flange 6 of a vehicle.

The first element 1 extends from the core-side power feeding unit 4 in a direction separated from the body flange 6 (for example, so as to form an angle of 45 degrees with respect to the body flange 6; an angle of 45 degrees in a diagonal direction toward the upper right in FIG. 1, for example) such that an angle of approximately 90 degrees is maintained between the first element 1 and the second element 2. The first element 1 is then bent back, for example, twice to form an element having a length corresponding to about $3\lambda/4$, where $\lambda$ represents a wavelength of a reception frequency. The second element 2 extends from the core-side power feeding unit 4 in a direction that is separated from the first element 1 by 90 degrees and is also separated from the body flange 6. The second element 2 is then bent, for example, twice to form an element having a length corresponding to about $\lambda/4$, where $\lambda$ represents the wavelength of the reception frequency.

The extending direction of the first element 1 may be not only at 45 degrees as illustrated in, for example, FIG. 1, but also at 60 degrees or 90 degrees. The first element 1 may be disposed appropriately so as to reduce an effective lateral width of the antenna and so as not to interfere with a driver's field of view. In order to improve efficiency, the angle formed between the extending direction of the first element 1 and the extending direction of the second element 2 may be set appropriately to about 90 degrees.

A length of the first element 1 may also be set smaller than a length of the second element 2. Specifically, it may also be possible to set the length of the first element 1 to about $\lambda/4$ and set the length of the second element 2 to about $3\lambda/4$. However, when the first element 1 is shortened, excitation timings are switched to each other so that the turning direction of the circularly polarized wave is reversed, which is appropriate for a left-turning polarized wave arriving from outside the vehicle. Accordingly, as the length of the first element 1 is increased, the sensitivity to a GPS signal as a right-turning polarized wave is improved.

In the antenna according to the first embodiment, on a side opposite to a side to which the elements 1 and 2 extend from the core-side power feeding unit 4, the body flange 6 is present in proximity to the core-side power feeding unit 4 and the earth-side power feeding unit 5. In other words, in the antenna according to the first embodiment, the core-side power feeding unit 4 and the earth-side power feeding unit 5 are provided at respective positions close to the body flange 6. For example, each of the power feeding units is provided such that the distance between the body flange 6 and facing sides of the power feeding units are from 5 millimeters to 20 millimeters. When the antenna according to the first embodiment is provided on a front window glass, an A-pillar on the front passenger seat side may be used as the body flange 6, and the antenna according to the first embodiment may be provided appropriately at a position on an upper portion of the front window glass which is along the A-pillar.

The core-side power feeding unit 4 and the elements 1 and 2 are included in a core-side antenna element, but the core-side antenna element may include the core-side power feeding unit 4 and the above-mentioned elements 1 and 2. Meanwhile, the earth-side power feeding unit 5 is included in an earth-side antenna element, but the earth-side antenna element may include the above-mentioned earth-side power feeding unit 5.

Each of the core-side power feeding unit 4 and the earth-side power feeding unit may also have a rectangular shape. The core-side power feeding unit 4 may appropriately have an area sufficient to allow the power feeding unit 4 to be bonded to a terminal to be bonded to the power feeding unit 4. The core-side power feeding unit 4 may also have an area that is about one to three times as large as that of the surface of the terminal. The earth-side power feeding unit 5 may also have, for example, an area larger than that of the core-side power feeding unit 4. When the earth-side power feeding unit 5 has a rectangular shape, the long sides thereof may also be arranged to extend along the body flange 6.

The core-side power feeding unit 4 and the earth-side power feeding unit 5 are arranged along the body flange 6 to be close to the body flange 6. Accordingly, in particular, the earth-side power feeding unit 5, in which the sides facing the body flange 6 are long, is strongly capacitively coupled to the body flange 6 to allow the body flange 6 to function as a ground plane.

In the antenna according to the first embodiment, when the size of the core-side power feeding unit 4 is increased, the respective lengths of the first element 1 and the second element 2 can be reduced. In addition, through varying of the size of the earth-side power feeding unit 5, the impedance of the antenna can be adjusted. When the visual appearance of the antenna is prioritized, it is preferred to adjust the respective sizes and lengths of the individual elements of the antenna such that the area of the earth-side power feeding unit 4 is equal to or less than 250 square millimeters.

In the second bent back portion of the first element 1, a bridge line 11 configured to short-circuit the first element 1 is provided. The bridge line 11 allows an inductive property to be given to the antenna and allows the impedance of the antenna to be adjusted.

The core-side power feeding unit 4 and the earth-side power feeding unit 5 are coupled to an amplifier (not shown) via a coaxial cable.

The conductors (lines and power feeding units) included in the antenna according to the first embodiment are formed by printing, onto a glass surface, a conductive ceramic paste in the forms of lines each having a width of about 0.7 millimeter, drying the ceramic paste, and then baking the ceramic paste onto the glass surface by a heating oven. It may also be possible to form the antenna of a conductive pattern in which each of the conductors is formed on a light transmissive resin film and then attach the antenna onto a glass plate.

Next, the principle of operation of the antenna according to the first embodiment is described.

The antenna of this embodiment is a single-point-feed circular polarized antenna using perturbative excitation. The first element 1 and the second element 2, which are spatially orthogonal to each other, resonate at two different frequencies to generate a circularly polarized wave. To achieve the perturbative excitation, the two elements have respective lengths obtained by offsetting respective lengths, which resonate the two elements, by +δ and −δ. However, in the antenna of the first embodiment, the respective amounts δ of length offset from the length (3λ/4) of the first element 1 and the length (λ/4) of the second element 2 may be the same or different. Specifically, it may be possible to equalize respective offset lengths for the two elements and set the length of the first element 1 to 3λ/4+δ, while setting the length of the second element 2 to λ/4−δ. Alternatively, it may also be possible to differentiate the respective offset lengths for the two elements and set the length of the first element 1 to 3λ/4+δ1, while setting the length of the second element 2 to λ/4−δ2. When positive offset (elongation) is performed on one of the elements, negative offset (reduction) is performed on another element.

The offset amounts δ vary depending on the line widths of the elements or an electrical property (relative permittivity or dielectric tangent) of glass to be used as a substrate. With a practical line width (0.7 millimeter) in the antenna of the first embodiment, a maximum value of the offset amounts δ is about αλ/10 (α represents a wavelength shortening rate of a substrate material, and λ represents the wavelength of a reception frequency in free space).

In FIG. 1, the lengths of the elements of the antenna appropriate for a GPS L1 band (1,575.42 MHz) are illustrated. Specifically, when the wavelength shortening rate α of glass is assumed to be 0.7, in the antenna for the GPS L1 band, the first element 1 extends from the core-side power feeding unit 4 in a direction of 45 degrees over 25 millimeters, is bent back in a U-shape with a width of 6 millimeters, extends in a direction of 225 degrees over 25.5 millimeters, and is bent back again in a U-shape with a width of 7.5 millimeters to extend in a direction of 45 degrees over 23 millimeters. The bridge line 11 is provided at a position 5 millimeters apart from the second bent back portion. A total length of the first element 1 is 87 millimeters. Meanwhile, the second element 2 extends from the core-side power feeding unit 4 in a direction of 135 degrees over 22 millimeters, is bent in a direction of 225 degrees to extend over 15.5 millimeters, and is bent in a direction of 135 degrees to extend over 8.5 millimeters. A total length of the second element 2 is 46 millimeters.

The core-side power feeding unit 4 is formed to have a lateral dimension of 11 millimeters and a vertical dimension of 5 millimeters. The earth-side power feeding unit 5 is formed to have a lateral dimension of 11 millimeters and a vertical dimension of 24 millimeters. The earth-side power feeding unit 5 is disposed under the core-side power feeding unit 4 (in a direction of 180 degrees) to be spaced 5 millimeters apart therefrom.

It should be noted that the dimensions of the antenna are determined by adjusting the resonance frequencies within a reception frequency band so as to obtain excellent sensitivity in the entire reception frequency band, and are not limited to the dimensions given above.

Figure 2:
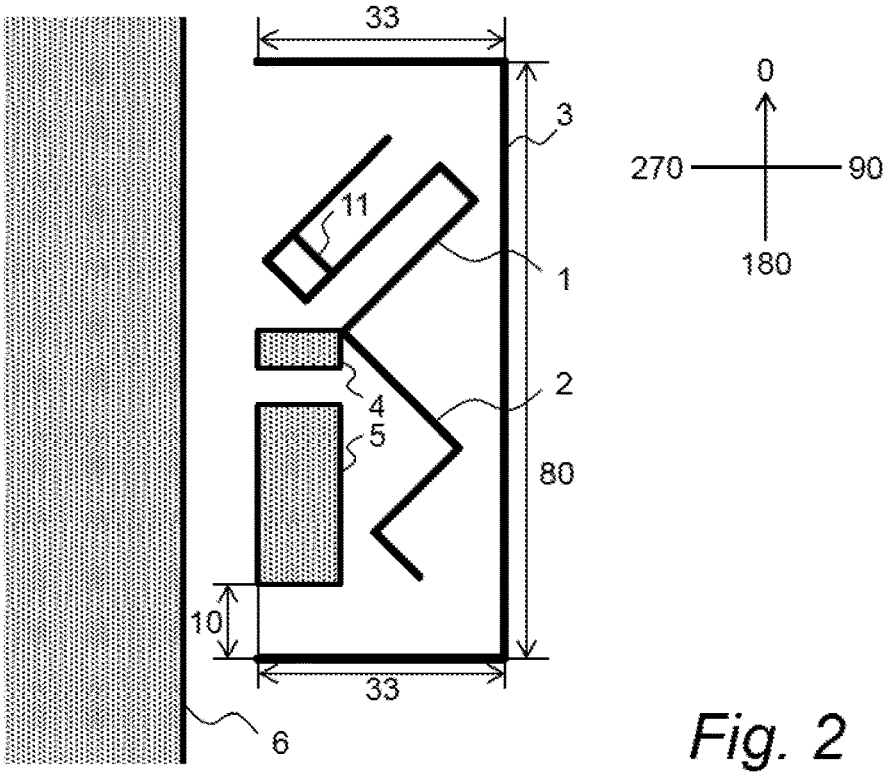
FIG. 2 is a plan view of a glass antenna (having a capacitive element) according to a second embodiment of this invention as viewed from the vehicle interior side.

FIG. 2 is a plan view of a glass antenna according to a second embodiment of this invention as viewed from the vehicle interior side.

The glass antenna illustrated in FIG. 2 is provided with a capacitive element 3 in the antenna of the first embodiment described above. In the second embodiment, the configurations of the first element 1, the second element 2, the core-side power feeding unit 4, and the earth-side power feeding unit 5 are the same as those in the first embodiment described above, and a description thereof is therefore omitted.

The parasitic element 3 is formed in a U-shape (laterally facing U-shape) open to the left so as to surround the first element 1, the second element 2, the core-side power feeding unit 4, and the earth-side power feeding unit 5. Specifically, an upper line of the parasitic element 3 is provided over the first element 1, a side line of the parasitic element 3 is provided on the right side of the first element 1 and the second element 2, and a lower line of the parasitic element 3 is provided under the second element 2.

The lower line of the parasitic element 3 is provided at a position 10 millimeters apart from a lower end of the earth-side power feeding unit 5. Each of the upper and lower lines of the parasitic element 3 has a length of 33 millimeters, while the side line thereof has a length of 80 millimeters. Accordingly, the right end of the first element 1 and the side line of the parasitic element 3 are about 4 millimeters apart from each other.

Figure 5:
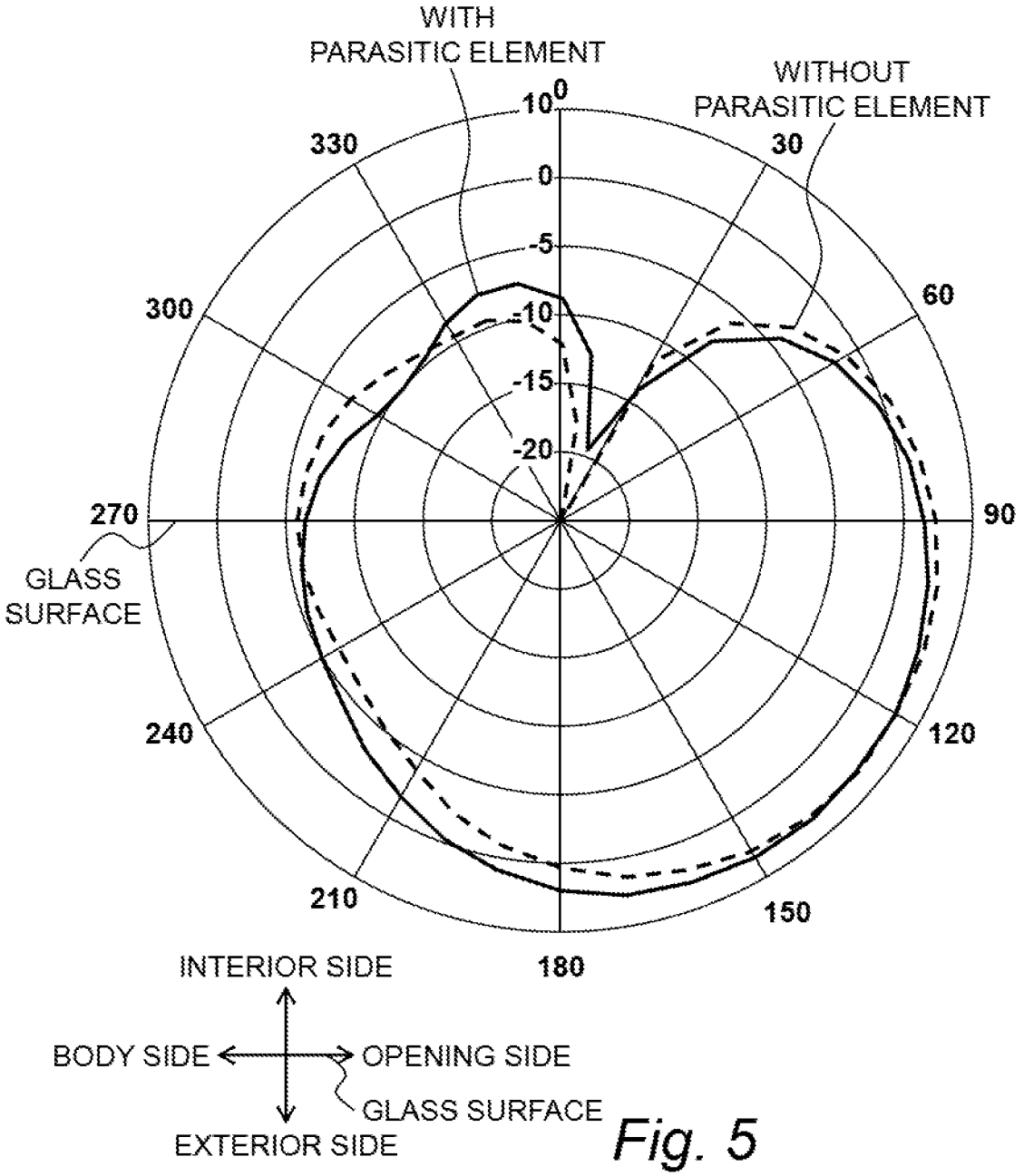
FIG. 5 is a diagram for illustrating characteristics of the glass antennas of the embodiments of this invention.

Through provision of the parasitic element 3, as illustrated in FIG. 5, the sensitivity in directions of from 150 degrees to 260 degrees, that is, on the left side (body flange 6 side) in a direction perpendicular to the glass surface, is improved.

Figure 3:
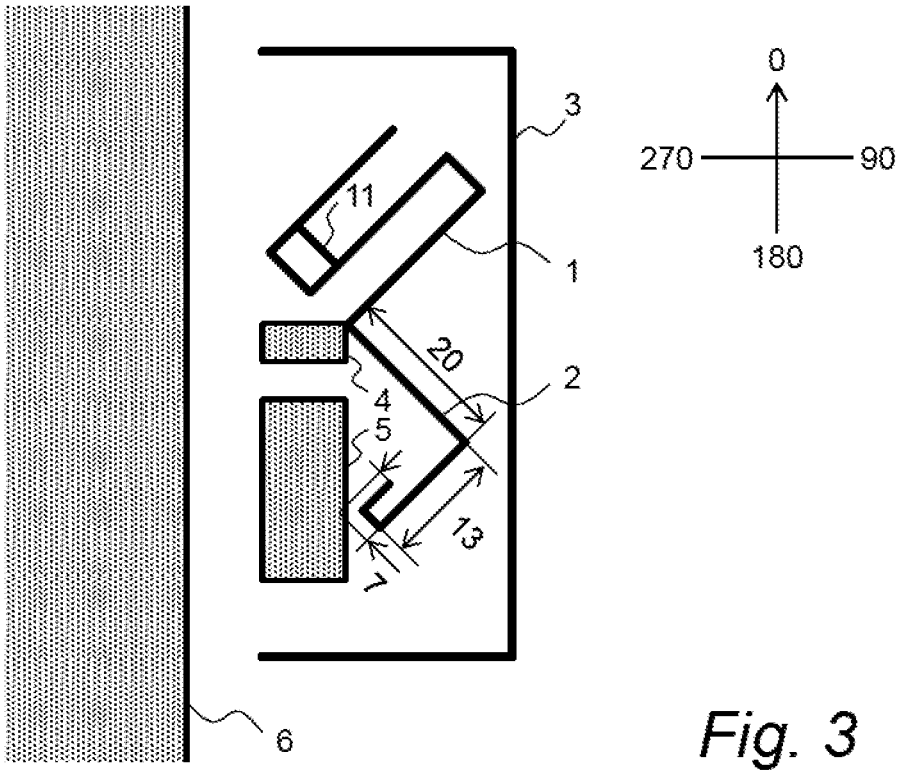
FIG. 3 is a plan view of a glass antenna (having a bending back leading end) according to a third embodiment of this invention as viewed from the vehicle interior side.

FIG. 3 is a plan view of a glass antenna according to a third embodiment of this invention as viewed from the vehicle interior side.

The glass antenna illustrated in FIG. 3 is provided with a bending back a leading end of the second element 2 of the antenna of the second embodiment described above. In the third embodiment, the configurations of the first element 1, the parasitic element 3, the core-side power feeding unit 4, and the earth-side power feeding unit 5 are the same as those in the first and second embodiments described above, and a description thereof is therefore omitted.

The second element 2 extends from the core-side power feeding unit 4 in a direction separated from the first element 1 by 90 degrees to be bent once, and is then bent back to form an element having a length corresponding to about λ/4, where λ represents the wavelength of the reception frequency.

In FIG. 3, the length of the second element 2 appropriate for the GPS L1 band (1,575.42 MHz) is illustrated. The dimensions of the first element 1, the parasitic element 3, the core-side power feeding unit 4, and the earth-side power feeding unit 5 are the same as those in the first and second embodiments described above, and illustration thereof is therefore omitted.

Assuming that the wavelength shortening rate α of glass is 0.7, in the antenna for the GPS L1 band, the second element 2 extends from the core-side power feeding unit 4 in a direction of 135 degrees over 20 millimeters, is bent in a direction of 225 degrees to extend over 13 millimeters, and is then bent back to extend in a direction of 45 degrees. A total length of the second element 2 is 40 millimeters. It should be noted that the dimensions of the antenna are determined by adjusting the resonance frequencies within the reception frequency band so as to obtain excellent sensitivity in the entire reception frequency band, and are not limited to the dimensions given above.

Figure 4:
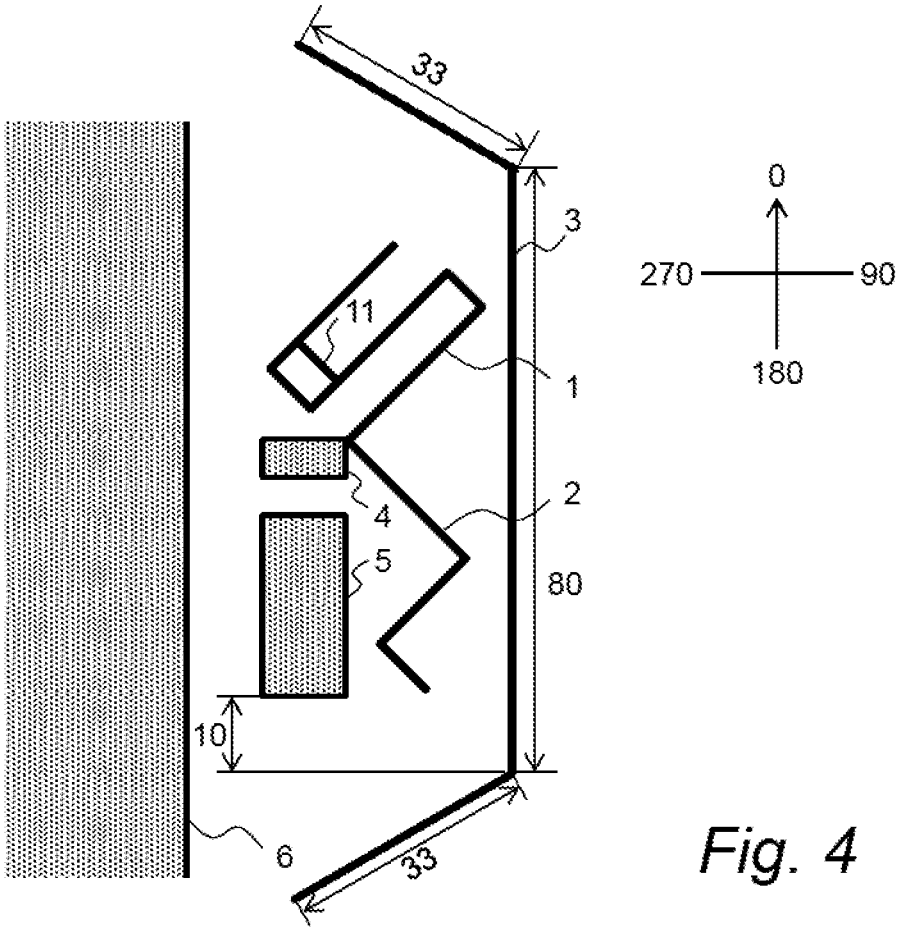
FIG. 4 is a plan view of a glass antenna (having a modified example of a capacitive element) according to a fourth embodiment of this invention as viewed from the vehicle interior side.

FIG. 4 is a plan view of a glass antenna according to a fourth embodiment of this invention as viewed from the vehicle interior side.

The glass antenna illustrated in FIG. 4 is different from that of the second embodiment described above in the shape of the parasitic element 3. In the fourth embodiment, the configurations of the first element 1, the second element 2, the core-side power feeding unit 4, and the earth-side power feeding unit 5 are the same as those in the first and second embodiments described above, and a description thereof is therefore omitted.

The parasitic element 3 is formed in a U-shape (laterally facing U-shape) open to the left so as to surround the first element 1, the second element 2, the core-side power feeding unit 4, and the earth-side power feeding unit 5. Specifically, the upper line of the parasitic element 3 is provided over the first element 1, the side line of the parasitic element 3 is provided on the right side of the first element 1 and the second element 2, and the lower line of the parasitic element 3 is provided under the second element 2. In the parasitic element 3 of the fourth embodiment, the upper line and the lower line are disposed diagonally so as to widen an opening side (left side).

The parasitic element 3 is disposed such that the intersection point of the side line and the lower line is at a position 10 millimeters apart from the lower end of the earth-side power feeding unit 5. In the parasitic element 3, each of the upper and lower lines has a length of 33 millimeters, while the side line has a length of 80 millimeters.

In the same manner as in the second embodiment described above, through provision of the parasitic element 3, it is possible to improve the sensitivity on the left side (body flange 6 side) in a direction perpendicular to the glass surface. Additionally, in the antenna in the fourth embodiment, through enlargement of the opening of the parasitic element 3, directivity can be changed.

While the example in which the body flange 6 is the A-pillar on the front passenger seat side and the antenna is disposed on the upper portion of the front window glass of a right-hand drive vehicle, which is located on the front passenger seat side, has been described above, in a left-hand drive vehicle, it is appropriate to laterally reverse the modes illustrated in FIG. 1 to FIG. 4 and dispose the antenna on the right side along the body flange 6. The body flange 6 may also be the vehicle body (roof portion) over the front window glass. In this case, the antenna of the fourth embodiment is disposed on the upper portion of the front window glass under a state in which the modes illustrated in FIG. 1 to FIG. 4 have clockwise rotated by 90 degrees. Alternatively, the antenna of the fourth embodiment may also be provided on another window glass along the body flange 6.

FIG. 5 is a diagram for illustrating characteristics of the glass antennas of the first and second embodiments.

In FIG. 5, the 90-270 degree line corresponds to a glass surface, 0 degrees corresponds to the vehicle interior, and 180 degrees corresponds to the vehicle exterior. In other words, in FIG. 5, the directivities in a plane orthogonal to the glass surface are illustrated. In FIG. 5, the directivity of the antenna of the first embodiment, in which the parasitic element 3 is not provided, is indicated by the broken line, while directivity of the antenna of the second embodiment, in which the parasitic element 3 is provided, is indicated by the solid line.

As can be seen from FIG. 5, the antenna of the first embodiment has the directivity in directions of from 90 degrees to 150 degrees. In the antenna of the second embodiment, the provision of the capacitive element 3 improves the sensitivity in directions of from 150 degrees to 260 degrees, that is, on the left side (body flange 6 side) in a direction perpendicular to the glass surface.

Figure 6:
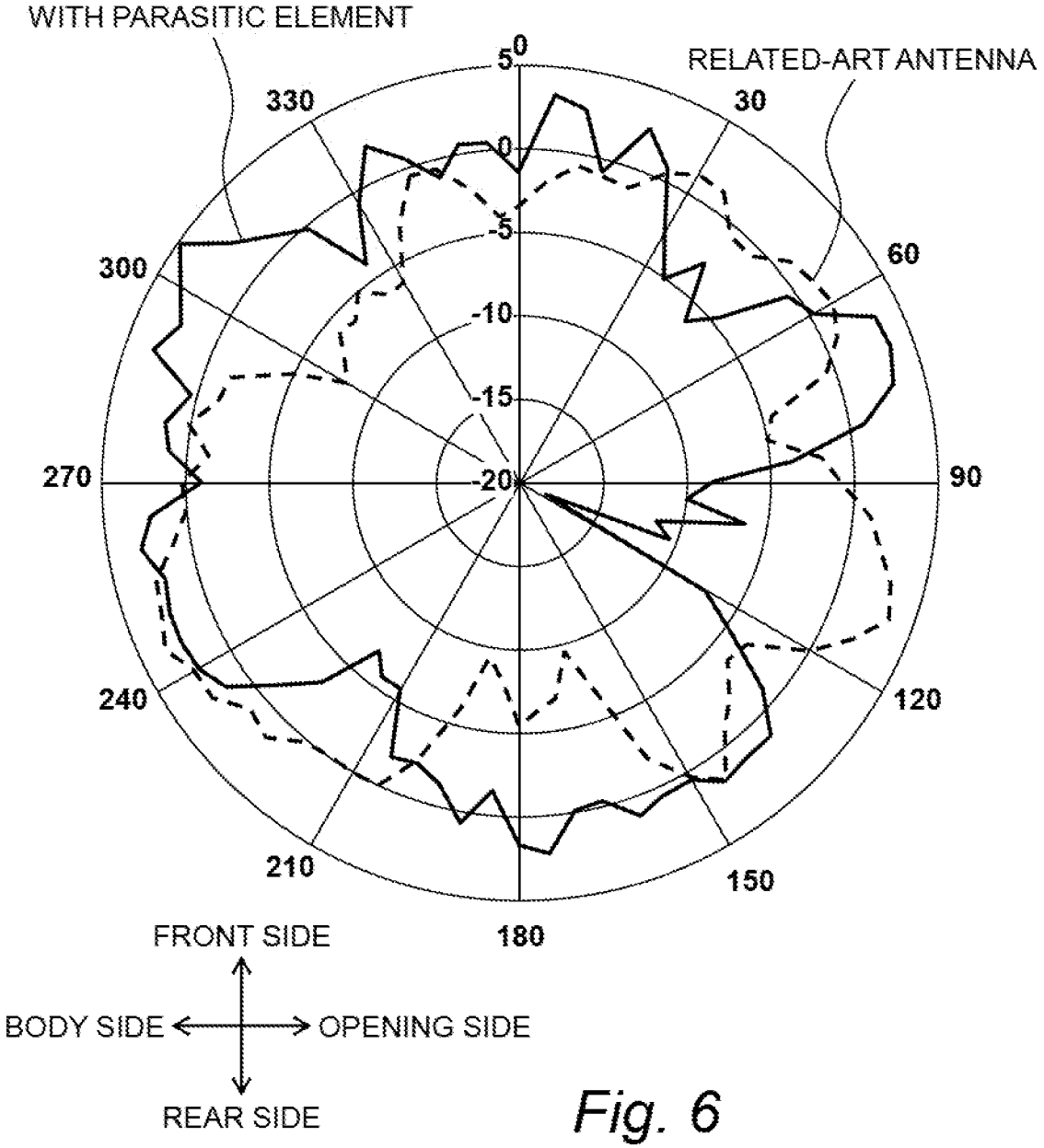
FIG. 6 is a diagram for illustrating characteristics of the glass antennas of the embodiments of this invention.

FIG. 6 is a diagram for illustrating the directivity of the glass antenna of the second embodiment.

In FIG. 6, the surface of the drawing sheet corresponds to the glass surface, 0 degrees corresponds to a vehicle front side, and 180 degrees corresponds to a vehicle rear side. In FIG. 6, the directivity of the antenna (with the capacitive element) of the second embodiment is indicated by the solid line, while directivity of a related-art antenna is indicated by the broken line.

As can be seen from FIG. 6, the related-art antenna is affected by the body flange 6 (A-pillar on the right side of the antenna) so that the sensitivity in a range of from 270 degrees to 330 degrees deteriorates to offset the directivity in a direction toward the center of the glass (opposite to the vehicle body side). In the antenna of the second embodiment, the sensitivity in the range of from 270 degrees to 330 degrees is improved to allow the directivity in a direction perpendicular to the glass toward the vehicle exterior to be obtained.

As described above, even when the glass antenna of each of the embodiments of this invention is disposed on a narrow area of the automotive window glass, the glass antenna can provide excellent reception performance.

Additionally, through provision of the bridge line 11, it becomes easier to adjust the impedance of the antenna.

Additionally, through provision of the parasitic element 3, it is possible to improve the sensitivity in the directions of from 150 degrees to 260 degrees, that is, on the left side (body flange 6 side) in a direction perpendicular to the glass surface. Moreover, through modification of the shape of the parasitic element 3, the directivity can be changed.

The parasitic element 3 also has the effect of reducing influence of a noise generating element, such as a heating wire, a camera, or a radar, which may affect the receiving sensitivity of the glass antenna of this invention. For example, on a window glass of a vehicle, in order to allow the window glass to exhibit an antifogging property, extremely fine heating wires each having a width of 30 micrometers or less are arranged at intervals of from 0.125 millimeter to 0.25 millimeter. For example, when attention is focused on the glass antenna of FIG. 2 (the body flange 6 is assumed to be on the A-pillar side), the extremely fine heating wires are arranged substantially in parallel to the line of the parasitic element 3 corresponding to the bottom portion of the U-shape. Even when the extremely fine heating wire closest to the parasitic element 3 is brought closer to the line of the parasitic element 3 corresponding to the bottom portion of the U-shape until the distance therebetween becomes 55 millimeters, the antenna property remains unaffected. Even when the closest extremely fine heating wire is brought closer to an equivalent position on the glass antenna in FIG. 1, the degradation of the antenna property is observed. Accordingly, in the glass window including the glass antenna including the parasitic element 3, the extremely fine heating wires can be arranged in a wider range all over the glass window to allow the region of the window that can perform the antifogging function to be expanded.

While the present invention has been described in detail and pictorially in the accompanying drawings, the present invention is not limited to such detail but covers various obvious modifications and equivalent arrangements, which fall within the purview of the appended claims.

The present application claims priority from Japanese patent application JP2017-79075 filed on Apr. 12, 2017, the content of which is hereby incorporated by reference into this application.

What is claimed is:

1. An antenna to be arranged on a window glass of a vehicle, the antenna comprising:

a core-side power feeding unit;

an earth-side power feeding unit;

a first element extending from the core-side power feeding unit; and a second element extending at an angle of approximately 90 degrees with respect to the first element from the core-side power feeding unit, the first element having a length of $3\alpha\lambda/4+\delta$ and the second element having a length of $\alpha\lambda/4-\delta$, or the first element having a length of $3\alpha\lambda/4-\delta$ and the second element having a length of $\alpha\lambda/4+\delta$, where $\lambda$ refers to a wavelength of a reception frequency, $\alpha$ refers to a wavelength shortening rate of glass, and $\delta$ refers to an offset length for each of the first element and the second elements.

2. The antenna according to claim 1, wherein the core-side power feeding unit and the earth-side power feeding unit are arranged along a body flange of the vehicle, and wherein each of the first element and the second element extends from the core-side power feeding unit in a direction separated from the body flange.

3. The antenna according to claim 1, wherein the first element is formed on the window glass to have a shape by bending back the first element at least once, and wherein the antenna further comprises a bridge line configured to short-circuit portions of the first element before and after a bent back portion of the first element.

4. The antenna according to claim 1, further comprising a parasitic element including a line having three sides surrounding the first element, the second element, the core-side power feeding unit, and the earth-side power feeding unit, wherein, on an opening side of the parasitic element, the earth-side power feeding unit is disposed along a body flange of the vehicle.

5. The antenna according to claim 4, wherein the parasitic element includes:

a side line, which is provided on a lateral side of each of the first element and the second element;

an upper line, which is provided over the first element, and has one end coupled to the side line; and a lower line, which is provided under the second element, and has one end coupled to the side line, and wherein another end portion of the upper line and another end portion of the lower line form an opening, and the opening have a size larger than a length of the side line.

6. A window glass, comprising the antenna of claim 1 being arranged on the window glass.

* * * * *